US005967893A

United States Patent [19]

Lawrence et al.

[11] Patent Number: 5,967,893

[45] Date of Patent: Oct. 19, 1999

[54] METHOD FOR TABULATING PAYOUT VALUES FOR GAMES OF CHANCE

[75] Inventors: Roger P. Lawrence, Boulder Creek; Eagle I. Berns, Palo Alto; Gregory P. Bala, San Jose, all of Calif.

[73] Assignee: Silicon Gaming, Inc., Palo Alto, Calif.

[21] Appl. No.: 08/925,094

[22] Filed: Sep. 8, 1997

[51] Int. Cl.[6] ..... A63F 9/24

[52] U.S. Cl. ..... 463/10; 463/13; 463/16; 463/20; 463/25

[58] Field of Search ..... 463/10, 11, 12, 463/13, 25, 16, 17, 20, 22; 707/1, 3, 7

[56] References Cited

U.S. PATENT DOCUMENTS 5,401,023 3/1995 Wood ..... 463/13
5,490,258 2/1996 Fenner ..... 707/1
5,630,753 5/1997 Fuchs ..... 463/13

*Primary Examiner*—Jessica J. Harrison
*Attorney, Agent, or Firm*—Claude A.S. Hamrick; Oppenheimer W. Donnelly; Justin Boyce

[57] ABSTRACT

A method for ordering all of the possible hands into a particular sequence is presented. Due to the particular manner in which the hands are ordered and sequenced, any one of the hands can be accessed fairly quickly by the methods provided herein which simplifies complex calculations to table look-up operations. Given a particular hand (the first five cards given to the player in a five-card draw poker), all of the possible hands arising from the particular hand (as a result of the number of cards kept by the player) is iterated and the types of all possible resulting hands tabulated. The combination of hands resulting from the number of cards kept is considered in the iteration. After the iteration is completed, the results obtained is a tabulation of each combination of hands obtained.

18 Claims, 3 Drawing Sheets

METHOD FOR TABULATING PAYOUT VALUES FOR GAMES OF CHANCE

BACKGROUND OF THE INVENTION

1. Field of the Invention

The present invention generally relates to methods for electronic games of chance, and, more particularly, to methods for determining payout amounts for electronic games of chance.

2. Description of the Prior Art

Wherever a new game of chance is developed or a new payout scheme is developed for a game of chance, it is necessary to calculate the amount payable to the player for the game in order for the owner of the game or the administrative agency regulating the game of chance to properly evaluate the acceptability of the payout scheme.

For example, in a 5-card draw video poker game of chance where the player deposits a certain amount of money to play the game and is dealt five cards with the option of keeping zero or more of the cards in favor of exchanging for new cards, a variety of betting and paying options are available depending on the player's final hand, which in traditional poker can be a single-card high, a pair, two pairs, three-of-a-kind, straight, flush, full-house, straight-flush, four-of-a-kind, and royal flush. If a payout scheme is developed where each type of hand enumerated above is given a monetary value, the question then becomes what is the maximum payout, the average payout, or other statistical data of interest.

This problem is relatively simple if there is no drawing of new cards. The solution for a particular type of hand would then be the probability of that particular type of hand occurring multiplied by the payout value for that particular hand.

The problem becomes complicated when there is one or more drawing of cards where the number of possible outcomes becomes tremendously large. To further illustrate the situation, if the player receives a particular five-card hand and decides to give up two cards, the resulting hand depends on the two cards given up and the two new cards drawn. All of the possible resulting hands would have to be tabulated as a function of the number and the particular cards given up in order to properly understand the probability of the types of hands occurring and to calculate the corresponding payout statistics.

If this problem were to be solved by currently available computing methods and machines, it would take months if not years to calculate all of the probabilities of a particular game of chance. Thus, a new method is needed for the computation of the probabilities of the occurrence of the possible types of hands and the corresponding payout amounts.

SUMMARY OF THE INVENTION

It is therefore an object of the present invention to provide a method for calculating the various statistical payout information for a game of chance.

It is another object of the present invention to provide a method for computing the probabilities of types of hands occurring in a game of chance.

It is yet another object of the present invention to provide a method for ordering all the possible hands of a game of chance to allow fast access to any one of the possible hands in the particular game of chance.

Briefly, a presently preferred embodiment of the present invention is comprised of two parts. In the first part, an indexing method for ordering all of the possible hands into a particular sequence is illustrated. Due to the particular manner in which the hands are ordered and sequenced, any one of the hands can be accessed fairly quickly by the methods provided herein. In the second part, given a particular hand (e.g. the first five cards given to the player in a five-card draw poker), all of the possible hands arising from the particular hand (as a result of the number of cards kept by the player) are iterated and the types of all possible resulting hands tabulated. The combination of hands resulting from the number of cards kept is considered in the iteration. After the iteration is completed, the results obtained would be a tabulation of each combination of hands obtained. These combinations of hands are sorted by types of hands (pairs, three-of-a-kind, full house, etc.) using the indexing method described in the first part.

Being able to tabulate all of the combinations of hands possible for a particular hand, the process can be repeated for all the particular first five cards. In this manner, all of the possible combinations for all of the possible hands can be tabulated and statistically evaluated in conjunction with the corresponding projected payout amounts.

Although a presently preferred embodiment of the present invention described herein refers to a five-card draw poker (drawing once) for illustration purposes, the present invention is applicable to all games where there is a set having a finite number of objects therein and one or more objects drawn therefrom a predefined number of times with or without replacement of the objects drawn.

These and other features and advantages of the present invention will become well understood upon examining the figures and reading the following detailed description of the invention.

IN THE DRAWINGS

DETAILED DESCRIPTION OF THE PREFERRED EMBODIMENTS

In a presently preferred embodiment of the present invention, a fast indexing method is used in a novel method for tabulating all the combinations of all the possible hands resulting from a given hand for a defined game of chance. The indexing method is first described then followed by the description of the novel tabulation method.

Figure 1:
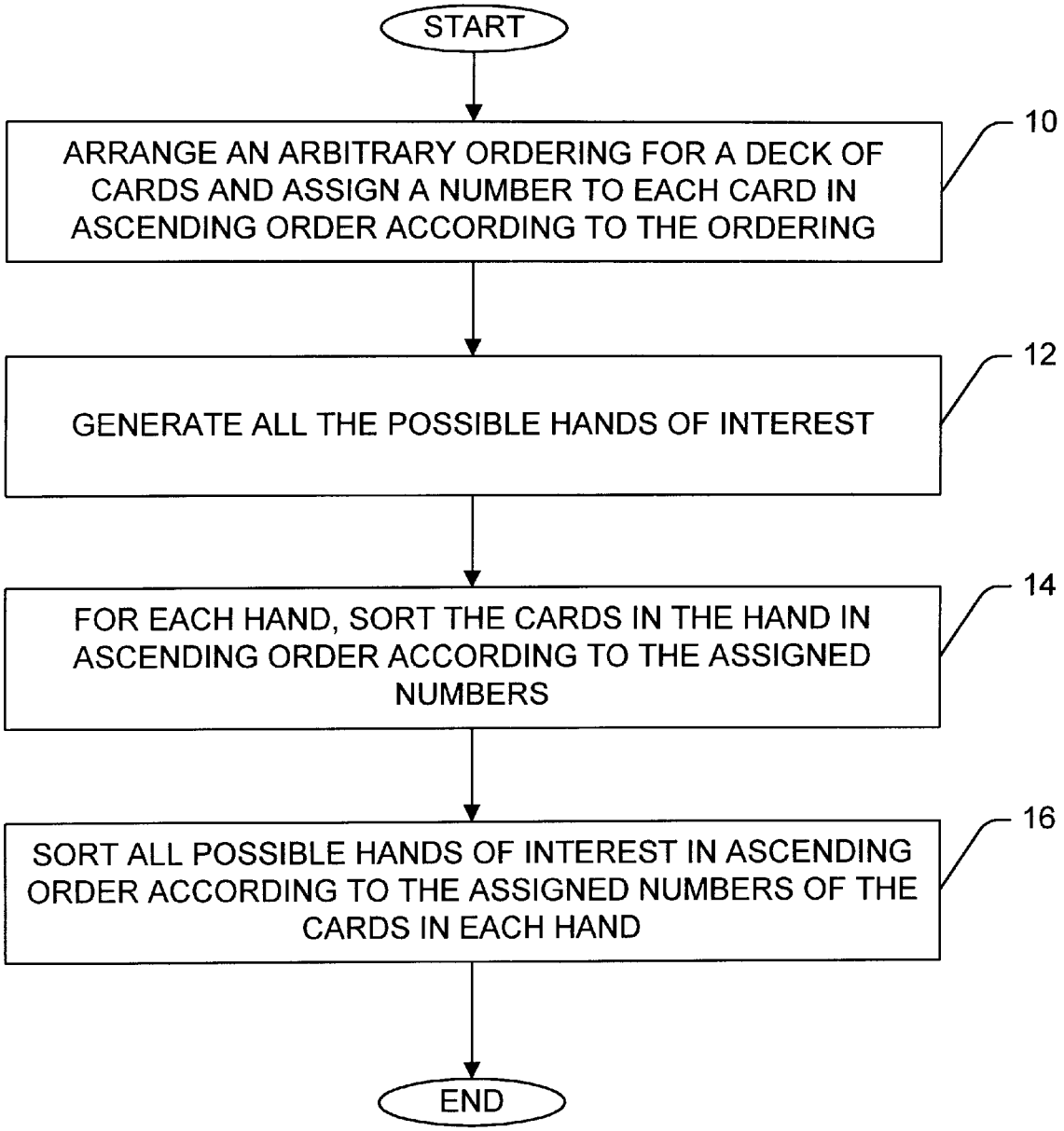
FIG. 1 illustrates the steps of a method for generating a master ordered list having all possible hands of interest sorted in a particular manner.

The indexing method maps all possible hands into a zero-based sequence. Referring to FIG. 1, a flow chart illustrates the steps involved in this indexing method. As is explained above, the presently preferred embodiment is illustrated using a five-card draw poker game as an example, but it is not thus limited.

Given a hand of five cards from a traditional deck of 52 cards in four suits, all possible combinations of five-card hands from the deck is arranged into a zero-based sequence. The sequence will have 2,598,960 elements, which is comb (52, 5), i.e. the number of combinations from 52 objects taken five at a time.

To arrange a zero-based sequence, an arbitrary ordering within the deck is established so that the deuce of hearts is assigned to the value zero, and other hearts are assigned in ascending order to sequentially higher numbers resulting in that the ace of hearts being assigned to the value 12. The assignment continues with clubs, diamonds, and spades, with the ace of spades being assigned to the value 51. With these value assignments, each five-card hand can be sorted so that the cards are arranged in numerically ascending order in accordance to the values of the respective cards. Furthermore, a ranking order can be arranged among the hands as well, where a list of all possible hands (2,598,960 rows long) would be ordered in the following manner (where "h" stands for hearts and "s" stands for spades):

| | | | | |
|---|---|---|---|---|
| 2h | 3h | 4h | 5h | 6h |
| 2h | 3h | 4h | 5h | 7h |
| 2h | 3h | 4h | 5h | 8h |
| | | . | | |
| | | . | | |
| | | . | | |
| 2h | 3h | 4h | 5h | Ah |
| 2h | 3h | 4h | 6h | 7h |
| 2h | 3h | 4h | 6h | 8h |
| | | . | | |
| | | . | | |
| | | . | | |
| 3h | 4h | 5h | 6h | 7h |
| 3h | 4h | 5h | 6h | 8h |
| | | . | | |
| | | . | | |
| | | . | | |
| 9s | 10s | Js | Qs | Ks |
| 9s | 10s | Js | Qs | As |
| | | . | | |
| | | . | | |
| | | . | | |
| 10s | Js | Qs | Ks | As |

The steps necessary to generate the master ordered list that minimizes the number of steps necessary to generate an index to any particular hand in the master list are illustrated in FIG. 1. In a first step 10, the cards (objects) in the deck (set of objects) are arranged in an arbitrary ordering and the ordered cards are assigned numbers in ascending order. In the next step 12, all of the possible hands of interest are generated from the deck of cards. Here, for a game of five card draw poker, the possible hands are hands of five cards, and all of the possible five card hands are generated. Now having all of the hands, the cards within each hand are sorted in ascending order according to their respectively assigned numbers 14. Next, all possible hands are sorted to generate a master list 16 and the items in the master list can be assigned with indices in an ascending sequential order.

Having now arranged all possible five-card hands into a master ordered list, given a particular five-card hand, a method for generating an index corresponding to the position of the particular five-card hand in the ordered list is explained below.

The method for generating an index is important because in a computing method, the list of the ordered hands is associated with the sequential elements of an array. In order to find the corresponding information for a particular hand, a fast indexing method is necessary in order to have an fast overall processing time.

Noting that the number of rows in the mastered ordered list that start with the card 2h is comb (51, 4), the number rows in the ordered list that starts with the card 3h is comb (50, 4) and so forth, a partial index can be generated from the value of the first card "C1" in the following manner:

$$\text{Partial_Index1} = \sum_{i=0}^{C1-1} \text{comb}(51-i, 4) \text{ for } C1 \geq 1;$$

$$\text{Partial_Index1} = 0 \text{ for } C1 = 0.$$

For the second card in a hand "C2", within all the rows in the table that begin with the same first card, the position of a row with a given second card is the sum of all the possible ordered combinations of the remaining cards taken three at a time. The number of remaining cards being given by 51−C2. Remembering that since the cards are ordered, the second card must be at least 1 greater than the first card. The partial index for the second card is thus given by:

$$\text{Partial_Index2} = \sum_{i=C1+1}^{C2-1} \text{comb}(51-i, 3) \text{ for } C2 > C1+1;$$

$$\text{Partial_Index2} = 0 \text{ for } C2 = C1+1$$

The same logic can be applied for the third through the fifth cards in the hand to give the following partial indices for card three C3, card four C4, and card five C5, respectively:

$$\text{Partial_Index3} = \sum_{i=C2+1}^{C3-1} \text{comb}(51-i, 2) \text{ for } C3 > C2+1;$$

$$\text{Partial_Index3} = 0 \text{ for } C3 = C2+1;$$

$$\text{Partial_Index4} = \sum_{i=C3+1}^{C4-1} \text{comb}(51-i, 1) \text{ for } C4 > C3+1;$$

$$\text{Partial_Index4} = 0 \text{ for } C4 = C3+1;$$

$$\text{Partial_Index5} = \sum_{i=C4+1}^{C5-1} \text{comb}(51-i, 0);$$

Note that partial_index 5 degenerates to C5−C4−2 as comb (x,0) degenerates to 1.

By summing all of the partial indices plus one, a full index is thereby generated from the hand expressed by C1, C2, C3, C4 and C5:

index=partial_index1+partial_index2+partial_index3+partial_index4+partial_index5;

Implementation wise, in order to avoid calculating the summations repeatedly, it is recognized that comb (x,y) can be pre-calculated where:

$$\sum_{i=a}^{b} f(i) = \sum_{i=0}^{b} f(i) - \sum_{i=0}^{a-1} f(i)$$

Now, each summation can be replaced by a pair of table lookups and a subtraction. Appendix A illustrates the C/C++ implementation source code.

Figure 2:
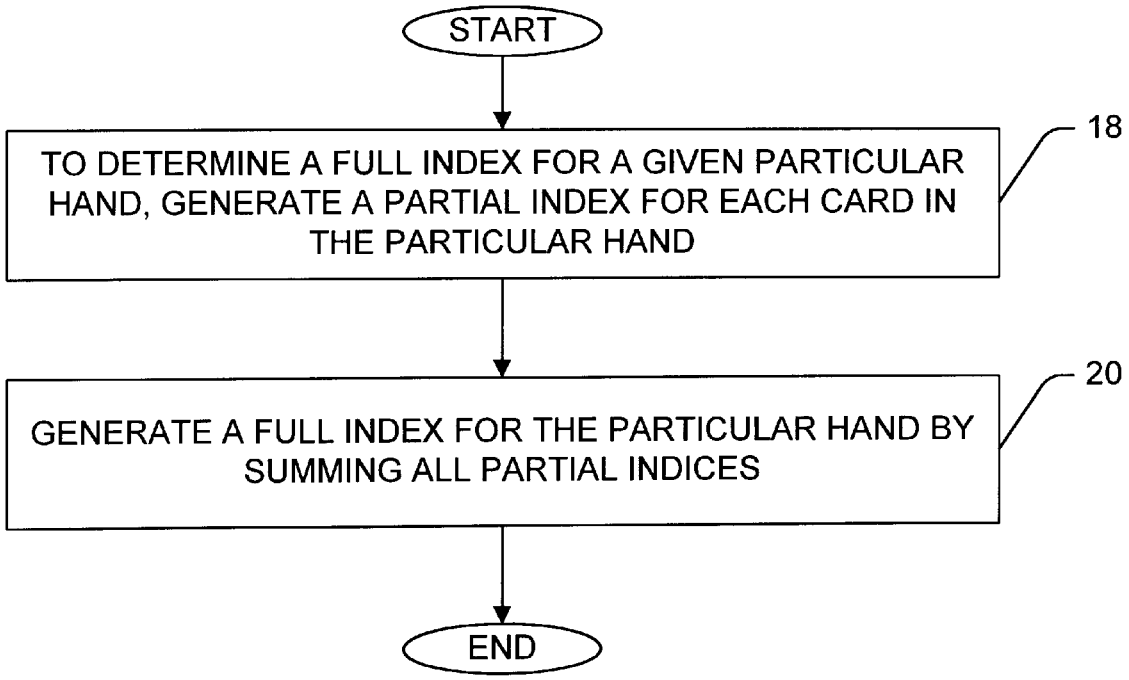
FIG. 2 illustrates the general steps in producing an index to the location of a given particular hand in the master list.

Having now provided a fast method for indexing and thereby accessing information associated with a particular hand, the method for finding all of the possible resulting hands given a particular five card hand can be explained as a two-step process which is illustrated in FIG. 2. In the first step 18, a partial index is generated based on each card in the hand of interest to produce five indices (for a five-card hand). In the second step 20, the partial indices are summed to generate the index for the given hand in the master list. The first step is now explained in greater detail.

In a game of five-card draw poker (drawing once), for any given first hand of five cards, the player may choose to hold or discard any or all of the cards. In holding (or discarding) the cards, there are 32 possible actions the player can pursue. For each action, there is a distribution of possible resulting hands with corresponding payout values. Table 1 illustrates the number of card(s) held, the corresponding number of variations in holding the cards, and the corresponding possible resulting hands.

TABLE 1

| Cards Held | Number of Variations | Resulting Hands |
|---|---|---|
| 0 | 1 | 1,533,933 or comb(47,5) |
| 1 | 5 | 178,365 or comb(47,4) |
| 2 | 10 | 16,215 or comb(47,3) |
| 3 | 10 | 1,081 or comb(47,2) |
| 4 | 5 | 47 or comb(47,1) |
| 5 | 1 | 1 or comb(47,0) |
| Total | 32 | 1,729,642 |

The task here is to identify for each of the 2,598,960 possible hands of poker, the highest expected return of all of the actions and, by summing that information, determine the expected payback percentage for the game as a whole. As is illustrated in Table 1, for any five-card hand, if no cards are held, there is only one way of discarding five cards which is comb (47,5) or 1,533,933 possible resulting hands. By holding one card and receiving four new cards, there are 178,365 possible resulting hands. Similarly, if two cards are held, there are ten ways of discarding three cards. By receiving three new cards, there are 16,215 possible resulting hands. The cases for holding four cards and five cards are illustrated as well.

Each of the 32 possible variations in user action gives rise to a number of different types of hand. For example, by discarding a particular card out of five cards and receiving one new card, there may be x-number of full-houses possible. However, by discarding a different card, there may be y-number of full-houses possible. For each variation, the tally of the occurrence of the type of hands is divided by the number of possible resulting hands for that particular variation to generate corresponding percentage values. These percentage values are then multiplied by the corresponding pay table entries for the particular types of hands (e.g. $10 for full house, $5 for two pairs, etc.) and summed. This final value is the expected payback value for the particular variation.

In order to tally all the occurrences of all possible resulting hands for a particular hand of five cards, a presently preferred method iterates through all of the possible hands through the deck (regardless of the cards or the number of cards held) and tallies all possible resulting hands using a novel method to mark cards occurring in both the first hand and the resulting hand.

Since the resulting hand can always be described in terms of the consequences of holding a certain number of cards in the same first hand, by determining the cards common to both hands in the iteration through all the possible hands, all variations in user actions, with regard to the number of card(s) held or the particular card(s) held, would have been considered.

Figure 3:
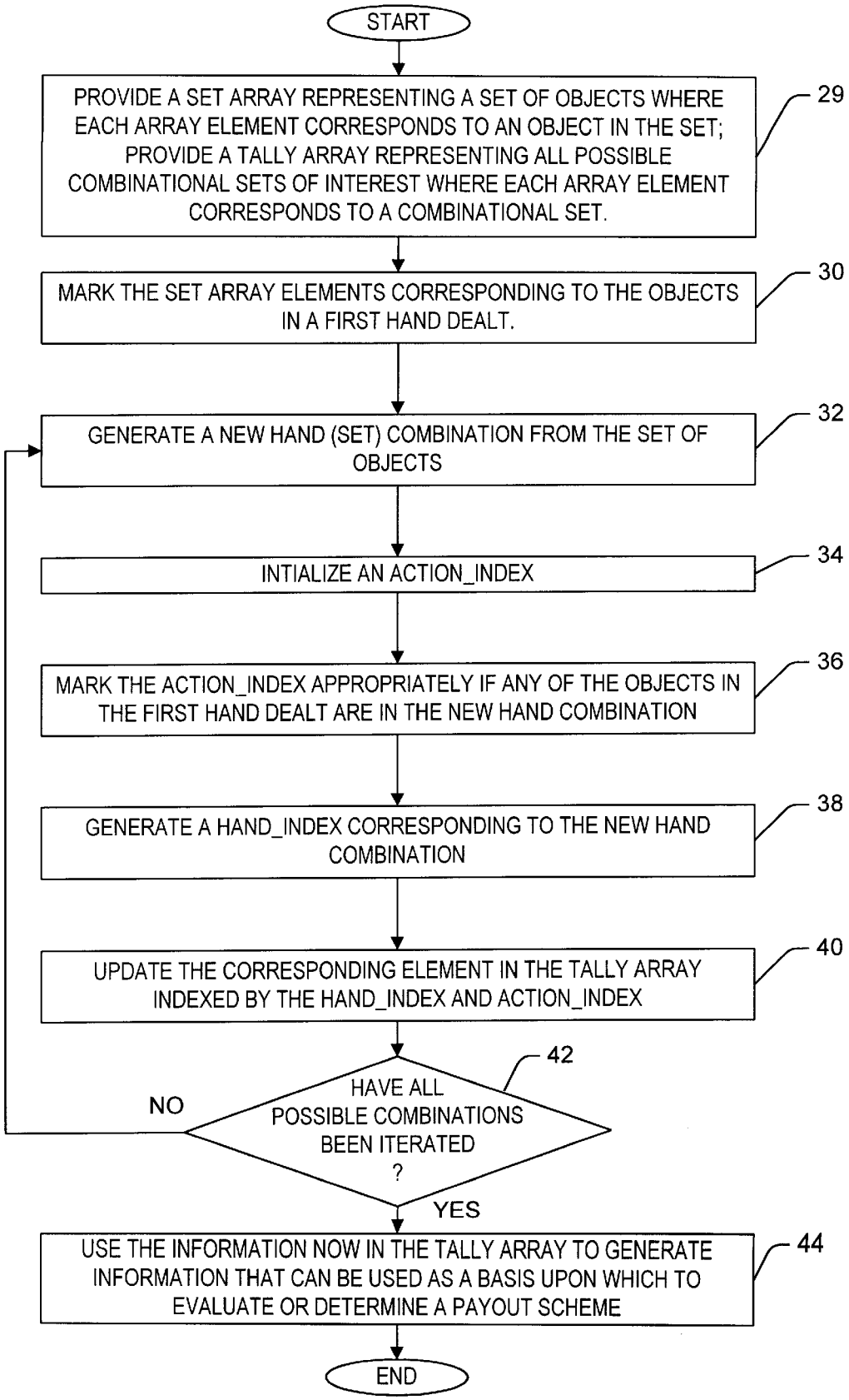
FIG. 3 illustrates the general steps in tabulating the occurrences of the types of hands for a given hand.

To illustrate, referring to FIG. 3, the first step 30 in this process is to mark, in an array representing a set of objects (such as a deck of cards) where each array element corresponds to an object in the set of objects, the array elements corresponding to the objects dealt in the first hand. The purpose of this step is to keep track of the cards common between the first hand and subsequent hand(s). Starting from the next step, all of the possible combinations of hands are iterated through to tabulate all of the possible resulting hands. In step 32, a new hand combination is generated. In step 34, an action index is initialized. The purpose of the action index is to track the common card(s), if any, between the hand dealt and the new hand generated. Additionally, it is also used as an index to a tally array for keeping the tally by user action for an initial given hand. Depending on the card(s) in common, the action index is marked accordingly. A marking scheme is illustrated by the C/C++ source code discussed below. In the next step 36, the action index is marked accordingly. In the presently preferred embodiment, the value of the action index is generated using an OR operation and the value of the action index indicates the array element to update. In the next step 38, a hand index is generated using the method described in part one and illustrated in FIG. 1. The hand index serves as a second index to the tally array and it indicates the element in the tally array to update. Having now provided the two indices for this embodiment to access and update the corresponding element in the tally array, the next step 40 is simply to increment the count at that array element by 1. This process repeats until all of the possible combinations for the set of objects have been iterated through.

After all of the combinations have been iterated through, all of the possible resulting hands have been tabulated (according to user action or otherwise), and all of the raw data (tabulation) have been obtained. Statistical information of interest can now be generated from it. For example, for an initial hand indicated by hand_index, the number of possible types of hands (e.g. pairs, flush, straight, etc.) indicated by Number_of_Types_of_Hands, the corresponding payout for each type of hand indicated by paytable[i], the number of possible resulting hands (shown in Table 1), and an action specified by action index, the expected payback is:

```
for (i = 0; i < Number_of_Types_of_Hands; i++)
    Payback_Total + = (Tally[hand_index][action_index]
    [i]*paytable [i])/
        Number_Of_Possible_Resulting_Hands[action_index];
```

Here, the complete C/C++ source code for a particular hand is illustrated. This code is executed for each hand, given by "handindex". The call below to "handValue (h1, h2, h3, h4, h5)" returns the value of the given hand. (In the actual implementation it is a table lookup). The array "value Tally" is a triply dimensioned array where "valueTally[i][x][y]" is the number of hands of kind "y" that arose from action "x" against initial hand "1".

```
/*    mark the array for all cards in the initial hand */
            for (i = 0; i < 5; i++) taken [hand[i]] = TRUE;
/*    iterate through all possible hands */
      for (C1 = 0; C1 < 48; C1++)
        for (C2 = C1 + 1; C2 < 49; C2++)
          for (C3 = C2 + 1; C3 < 50; C3++)
            for (C4 = C3 + 1; C4 < 51; C4++)
              for (C5 = C4 + 1; C5 < 52; C5++){
                actionIndex = 0
                if (taken[C1]) actionIndex |= 0 × 10;
                if (taken[C2]) actionIndex |= 0 × 08;
                if (taken[C3]) actionIndex |= 0 × 04;
                if (taken[C4]) actionIndex |= 0 × 02;
```

-continued

```
    if (taken[C5]) actionIndex |= 0 × 01;
    value = handValue (C1, C2, C3, C4, C5);
    valueTally[handIndex][actionIndex][value]++;
}
```

Although the present invention has been described in terms of specific embodiments it is anticipated that alterations and modifications thereof will no doubt become apparent to those skilled in the art. It is therefore intended that the following claims be interpreted as covering all such alterations and modifications as fall within the true spirit and scope of the invention.

APPENDIX A

```
const int Sum Table[5][52]=
{
{1, 2, 3, 4, 5, 6, 7, 8, 9, 10, 11, 12, 13
14, 15, 16, 17, 18, 19, 20, 21, 22, 23, 24, 25, 26,
27, 28, 29, 30, 31, 32, 33, 34, 35, 36, 37, 38, 39,
40, 41, 42, 43, 44, 45, 46, 47 48, 49, 50, 51, 52},
{51, 101, 150, 198, 245, 291, 336, 380, 423, 465, 506, 546, 585,
623, 660, 696, 731, 765, 798, 830, 861, 891, 920, 948, 975, 1001,
1026, 1050, 1073, 1095, 1116, 1136, 1155, 1173, 1190, 1206, 1221, 1235, 1248,
1260, 1271, 1281, 1290, 1298, 1305, 1311, 1316, 1320, 1323, 1325, 1326, 1326},
{1275, 2500, 3676, 4804, 5885, 6920, 7910, 8858, 9759, 10620, 11440, 12220,
12961,
13664, 14330, 14960, 15555, 16116, 16644, 17140, 17605, 18040, 18446, 18824,
19175, 19500,
19800, 20076, 20329, 20560, 20770, 20960, 21131, 21284, 21420, 21540, 21645,
21736, 21814,
21880, 21935, 21980, 22016, 22044, 22065, 22080, 22090, 22096, 22099, 22100,
22100, 22100},
{20825, 40425, 58849, 76145, 92360, 107540, 121730, 134974, 147315, 158795,
169455, 179335, 188474,
196910, 204680, 211820, 218365, 224349, 229805, 234765, 239260, 243320,
246974, 250250, 253175, 256775,
258075, 260099, 261870, 263410, 265740, 265880, 266849, 267665, 268345,
268905, 269360, 269724, 270010.
270230, 270395, 270515, 270599, 270655, 270690, 270710, 270720, 270724,
270725, 270725, 270725, 270725},
{249900, 480200, 692076, 886656, 1065021, 1228206, 1377201, 1512952, 1636362,
1748292, 1849562, 1940952, 2023203,
2097018, 2163063, 2221968, 2274328, 2320704, 2361624, 2397584, 2429049,
2456454, 2480205, 2500680, 2518230, 2533180,
2545830, 2556456, 2565311, 2572626, 2578611, 2583456, 2587332, 2590392,
2592772, 2594592, 2595957, 2596958, 2597673,
2598168, 2598498, 2598708, 2598834, 2598904, 2598939, 2598954, 2598959,
2598960, 2598960, 2598960, 2598960, 2598960}
};
int calculateIndex{int h1, int h2, int h3, int h4, int h5}
/*
given a sorted hand of cards, return its index in
the table of all such hands.
*/
{
int index = 0;
if(h1 > 0) index += Sum Table [4][{h1 − 1}]
if(h2 > (h1 + 1)) index += Sum Table [3][{h2 − 1}]- Sum Table [3]{[h1 + 1} − 1];
if(h3 > (h2 + 1)) index += Sum Table [2][{h3 − 1}]- Sum Table [2]{[h2 + 1} − 1];
if(h4 > (h3 + 1)) index += Sum Table [1][{h4 − 1}]- Sum Table [1]{[h3 + 1} − 1];
if(h5 > (h4 + 1)) index += (h5 − h4 − 2};
index ++;
return index;
}
```

I claim:

1. A computer-based method for tabulating distribution data associated with occurrences of possible resulting hands which may be drawn based on an initial hand for a particular game of chance, said initial hand and said resulting hands being dealt and drawn from a deck of a finite number of cards, selected numbers of the cards in said initial hand being discarded and replaced with cards from said deck to generate particular resulting hands, comprising the steps of:

a) providing an object-set storage array having a plurality of card storage locations each corresponding to a card in said deck of cards;

b) providing a tally array associated with an initial hand, said tally array having a plurality of tally storage locations each of said tally storage locations, being associated with, a corresponding one of a master set of possible resulting hands which may be drawn from said deck based on said initial hand, and a corresponding hold action, each of said tally storage locations providing for storage of an occurrence value representing tabulated occurrences of a corresponding resulting hand drawn as a result of said corresponding hold action;

c) marking the card locations corresponding to the cards in said initial hand;

d) generating a new combination of cards forming a new resulting hand;

e) initializing an action index;

f) marking said action index in accordance with a comparison of the cards in said initial hand and the cards in said new resulting hand, the marked action index indicating said corresponding hold action and providing a first index to said tally array;

g) generating a hand index as a function of said new resulting hand, said hand index providing a second index to said tally array;

h) updating an occurrence value stored in a particular one of said tally storage locations that is indicated by said first and second indices;

i) repeating steps d) through i) for each of said resulting hands of said master set which may be drawn from said deck based on said initial hand; and j) using said occurrence values stored in said tally array to generate information that can be used as a basis upon which to determine and evaluate a payout scheme.

2. A method as recited in claim 1 wherein said tally array storage locations associated with corresponding ones of said possible resulting hands in said master set are organized in a predetermined sequence, and wherein said step g) of generating a hand index includes the substeps of:

i) generating a partial index for each respective card in said new resulting hand as a function of said respective card and said predetermined sequence of said master set; and ii) summing said partial indices to generate said hand index.

3. A method as recited in claim 1 wherein each of said possible resulting hands of said master set is organized in a predetermined sequence in accordance with a sub-process comprising the substeps of:

i) assigning a value to each of the cards in said deck;

ii) generating all possible hands of interest from said cards;

iii) sorting the cards of each hand according to the assigned values of the cards of the hand; and iv) generating said master set by sorting said all possible hands of interest as a function of the assigned values of the cards in the hands; and v) corresponding each hand in said master set with an ordered index.

4. A method as recited in claim 1 wherein each of said occurrence values stored in said tally storage locations is multiplied by an associated payout value and divided by a predetermined possible-resulting-hand value associated with said corresponding action index to generate a corresponding partial payout value, said predetermined possible-resulting-hand value representing the number of possible resulting hands that may be drawn as a result of said corresponding hold action based on said initial hand.

5. A method as recited in claim 4 wherein said partial payout values are summed to produce said total payout value.

6. A method as recited in claim 1 further comprising repeating steps b) through j) for each possible combination of cards which may be dealt from said deck to generate said initial hand.

7. A computer-based method for tabulating possible distribution data associated with occurrences of resulting subsets of objects which may be drawn based on an initial subset of objects for games of chances, said objects of said resulting subsets and said initial subset being provided from a finite set of objects, a selected number of the objects in said initial subset being discarded and replaced with objects from said set to generate a particular resulting subset, wherein particular ones of the resulting subsets are tracked, comprising the steps of:

a) providing an object-set storage array having a plurality of elements each corresponding to an object in said set of objects;

b) providing a tally array associated with an initial subset of the objects, said tally array having a plurality of tally storage locations, each of said tally storage locations being associated with, a corresponding one of a master set of possible resulting subsets which may be drawn from said objects of said set based on said initial subset, and a corresponding hold action, each of said tally storage locations providing for storage of an occurrence value representing tabulated occurrences of said corresponding resulting subset drawn as a result of said corresponding action;

c) marking the elements in said object-set storage array corresponding to the objects in said initial subset;

d) generating a new combination of objects forming a new resulting subset;

e) initializing an action index;

f) marking said action index in accordance with a comparison of the objects in said initial subset and the objects in said new resulting subset, said action index indicating said corresponding hold action and providing a first index to said tally array;

g) generating a hand index as a function of said new resulting subset of objects, said hand index providing a second index to said tally array;

h) increasing an occurrence value stored in a particular one of said tall storage locations that is indicated by said first and second indices; and i) repeating step d) through step i) for each of said resulting subsets of said master set.

8. A method as recited in claim 7 wherein said tally storage locations corresponding to said possible resulting subsets of said master set are organized in a predetermined sequence, and wherein said step g) of generating said hand index includes the substeps of:

i) generating a partial index for each respective object in said new resulting subset as a function of said respective object and said predetermined sequence of said master set; and ii) summing said partial indices to generate said hand index.

9. A method as recited in claim 7 wherein said master set is organized in said predetermined sequence in accordance with a sub-process comprising the substeps of:

i) assigning a value to each of the objects in said set of objects;

ii) generating all possible subsets of interest from said set of objects;

iii) sorting the objects of each subset according to the assigned values of the objects within said subset;

iv) generating said master set by sorting said all possible subsets as a function of the assigned values of the objects in the subsets; and v) corresponding each subset in said master set with an ordered index.

10. A method as recited in claim 7 wherein each of said occurrence values stored in said tally storage locations is multiplied by an associated payout value and divided by a predetermined possible-resulting-hand value associated with said corresponding hold action to generate a corresponding partial payout value, said predetermined possible-resulting-hand value representing the number of possible resulting subsets that may be drawn from said set of objects as a result of said corresponding action based on said initial subset.

11. A method as recited in claim 10 wherein said partial payout values are summed to produce said total payout value.

12. A method as recited in claim 7 further comprising repeating said steps (b through j) for each possible combination of objects which may be provided from said set of objects to generate said initial subset.

13. A method for generating an index to a particular subset of objects in a master set having a plurality of subsets of objects ordered in a predetermined sequence, said master set of objects and said index being used for tabulating and accessing distribution data associated with games of chance, comprising the steps of:

a) generating a partial index for each object in a particular subset of objects as a function of a value assigned to each of the objects and the predetermined sequence of the subset of objects in said master set; and b) summing said partial indices to generate an index.

14. A method as recited in claim 13 wherein said master set having said plurality of subsets ordered in said particularly manner is ordered using the following substeps:

i) assigning a value to each of the objects in said set of objects;

ii) generating all possible combination subsets of interest from said set of objects;

iii) sorting each subset according to the assigned values of the objects within said subset;

iv) generating said master set by sorting said all possible combination subsets as a function of the assigned values of the objects in the subsets; and v) corresponding each subset in said master set with an ordered index.

15. A method as recited in claim 13 wherein said partial indices are generated as a function of the position of the object in the particular subset of objects of interest in accordance with the summation of the number of combinations of the number of objects in the set of objects minus y, where y equals the value of the last object plus one to the value of the current object minus one, taken x number at a time, where x equals the number of remaining objects in said particular subset of objects.

16. A method for arranging subsets of objects within a master set where the subset of objects are generated from a set of objects and for generating an index to a particular subset of interest within said master set, said master set having said plurality of subsets ordered in a predetermined sequence, said master set and said index being used for tabulating and accessing distribution data associated with games of chance, comprising the steps of:

a) assigning a value to each of the objects in said set of objects;

b) generating all possible combination subsets of interest from said set of objects;

c) sorting each of said subsets according to the assigned values of the objects within said subset;

d) generating said master set by sorting said all possible combination subsets as a function of the assigned values of the objects in the subsets; and e) corresponding each subset in said master set with an ordered index.

17. A method as recited in claim 16 further comprising a step of generating an index to a particular subset of objects in said master set, said step of generating said index including the steps of:

a) generating a partial index for each object in a particular subset of object of interest as a function of an assigned value to each of the objects and the particularly manner the subset of objects are ordered in said master set; and b) summing said partial indices to generate an index.

18. A method as recited in claim 17 wherein said partial indices are generated as a function of the position of the object in the particular subset of objects of interest in accordance with the summation of the number of combinations of the number of objects in the set of objects minus y, where y equals the value of the last object plus one to the value of the current object minus one, taken x number at a time, where x equals the number of remaining objects in said particular subset of objects.

* * * * *